US012434126B1

(12) United States Patent
Klis

(10) Patent No.: US 12,434,126 B1
(45) Date of Patent: Oct. 7, 2025

(54) ICE HOCKEY SKATE

(71) Applicant: James Klis, East Northport, NY (US)

(72) Inventor: James Klis, East Northport, NY (US)

( * ) Notice: Subject to any disclaimer, the term of this patent is extended or adjusted under 35 U.S.C. 154(b) by 0 days.

(21) Appl. No.: 19/042,773

(22) Filed: Jan. 31, 2025

Related U.S. Application Data

(63) Continuation-in-part of application No. 18/814,542, filed on Aug. 25, 2024.

(51) Int. Cl.
*A63C 1/30* (2006.01)
*A63C 1/36* (2006.01)

(52) U.S. Cl.
CPC ..... *A63C 1/303* (2013.01); *A63C 1/36* (2013.01)

(58) Field of Classification Search
CPC .. A63C 1/30; A63C 1/303; A63C 1/34; A63C 1/36
See application file for complete search history.

(56) References Cited

U.S. PATENT DOCUMENTS

| | | | | |
|---|---|---|---|---|
| 2,764,417 | A | 9/1956 | Sweet | |
| 2,867,445 | A * | 1/1959 | Lachat | A63C 1/36 280/11.12 |
| 5,456,495 | A * | 10/1995 | McLeod | A63C 1/00 280/11.12 |
| 6,203,028 | B1 * | 3/2001 | Kress | A63C 1/30 280/11.18 |
| 7,641,203 | B1 * | 1/2010 | Carey | A63C 1/36 280/11.12 |
| 12,053,688 | B2 | 8/2024 | Bollis | |
| 2014/0319790 | A1 * | 10/2014 | Mayer | A63C 1/303 280/11.18 |
| 2014/0327217 | A1 * | 11/2014 | Pokupec | A63C 1/36 280/11.18 |
| 2016/0114239 | A1 * | 4/2016 | Davis | A63C 1/32 280/11.12 |
| 2021/0086057 | A1 * | 3/2021 | Altshuler | A63C 1/32 |
| 2023/0347230 | A1 * | 11/2023 | Altshuler | A63C 1/32 |
| 2024/0181325 | A1 * | 6/2024 | Stefan | A63C 1/303 |

FOREIGN PATENT DOCUMENTS

| | | |
|---|---|---|
| CA | 2098228 | 12/1994 |
| CN | 201253469 | 6/2009 |
| CN | 201799086 | 4/2011 |
| CN | 102039043 A | 5/2011 |
| EP | 3354149 B1 | 7/2019 |
| KR | 1994000718 | 7/2019 |

* cited by examiner

*Primary Examiner* — Brian L Swenson

(57) ABSTRACT

An ice hockey skate includes a boot, a blade housing, a blade, and a plurality of projections. The boot includes a sole. The blade housing includes a mounting portion attached to the sole and a blade receptacle portion. The blade is removably connected to the blade receptacle portion. The projections project from the blade receptacle portion adjacent the blade and are designed to provide traction on an ice surface upon disconnection of the blade. Alternatively, the ice hockey includes a backup blade projecting from the blade housing next to and parallel to the blade, or a blade extension projecting from and integrally formed with the blade housing next to and parallel to the blade.

12 Claims, 12 Drawing Sheets

ICE HOCKEY SKATE

CROSS-REFERENCE TO RELATED APPLICATIONS

This application is a Continuation-in-Part of U.S. application Ser. No. 18/814,542, filed Aug. 25, 2024, which is hereby incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) FIELD OF THE INVENTION

The disclosure relates to ice hockey skates and more particularly pertains to a new ice hockey skate that includes a backup blade structure or a plurality of projections or teeth for providing temporary support and traction when a blade has inadvertently been disconnected or detached. Modern ice hockey skates generally include a boot and a blade housing mounted on the bottom of the boot. The blade housing has a blade receptacle portion at the end thereof where a blade is detachably connected, which allows a user, that is, a skater, to replace the blade if it becomes worn or damaged. One common occurrence is for skate blades to be accidentally or inadvertently disconnected or detached while a skater is skating, which results in the skater only being supported by the blade housing. Without the blade, the plastic blade housing slides on the ice, providing the skater with very little to no traction and an inability to skate. This situation is especially problematic during hockey games, as play usually does not stop and the team with the incapacitated skater must temporarily play shorthanded until that skater can exit the ice surface and be substituted by another player, which is a significant disadvantage and can last a substantial amount of time depending on how far away the skater is from the team bench area. The new ice hockey skate of the present application includes a backup blade or a plurality of projections that projects adjacent or next to the blade, such that when the blade is accidentally detached, sufficient temporary support and traction is provided such that the skater can use the broken skate to effectively and more quickly propel himself on the blade of the intact skate to the team bench area, thereby minimizing the time his team is shorthanded.

(2) DESCRIPTION OF RELATED ART INCLUDING INFORMATION DISCLOSED UNDER 37 CFR 1.97 AND 1.98

The prior art relates to ice hockey skates. The prior art, as best understood, does not disclose a set of projections or teeth that project from the blade housing adjacent the blade and are designed to provide traction on an ice surface upon disconnection of the blade. The prior art also does not disclose a temporary or backup blade that projects from the blade housing adjacent the blade and is designed to provide traction on an ice surface upon disconnection of the blade.

BRIEF SUMMARY OF THE INVENTION

An embodiment of the disclosure meets the needs presented above in an ice hockey skate generally comprising a boot, a blade housing, a blade, and a plurality of projections. The boot includes a sole. The blade housing includes a mounting portion attached to the sole and a blade receptacle portion. The blade is removably connected to the blade receptacle portion. The projections project from the blade receptacle portion adjacent the blade and are designed to provide traction on an ice surface upon disconnection of the blade.

Alternatively, the ice hockey includes a backup blade projecting from the blade housing next to and parallel to the blade, or a blade extension projecting from and integrally formed with the blade housing next to and parallel to the blade.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
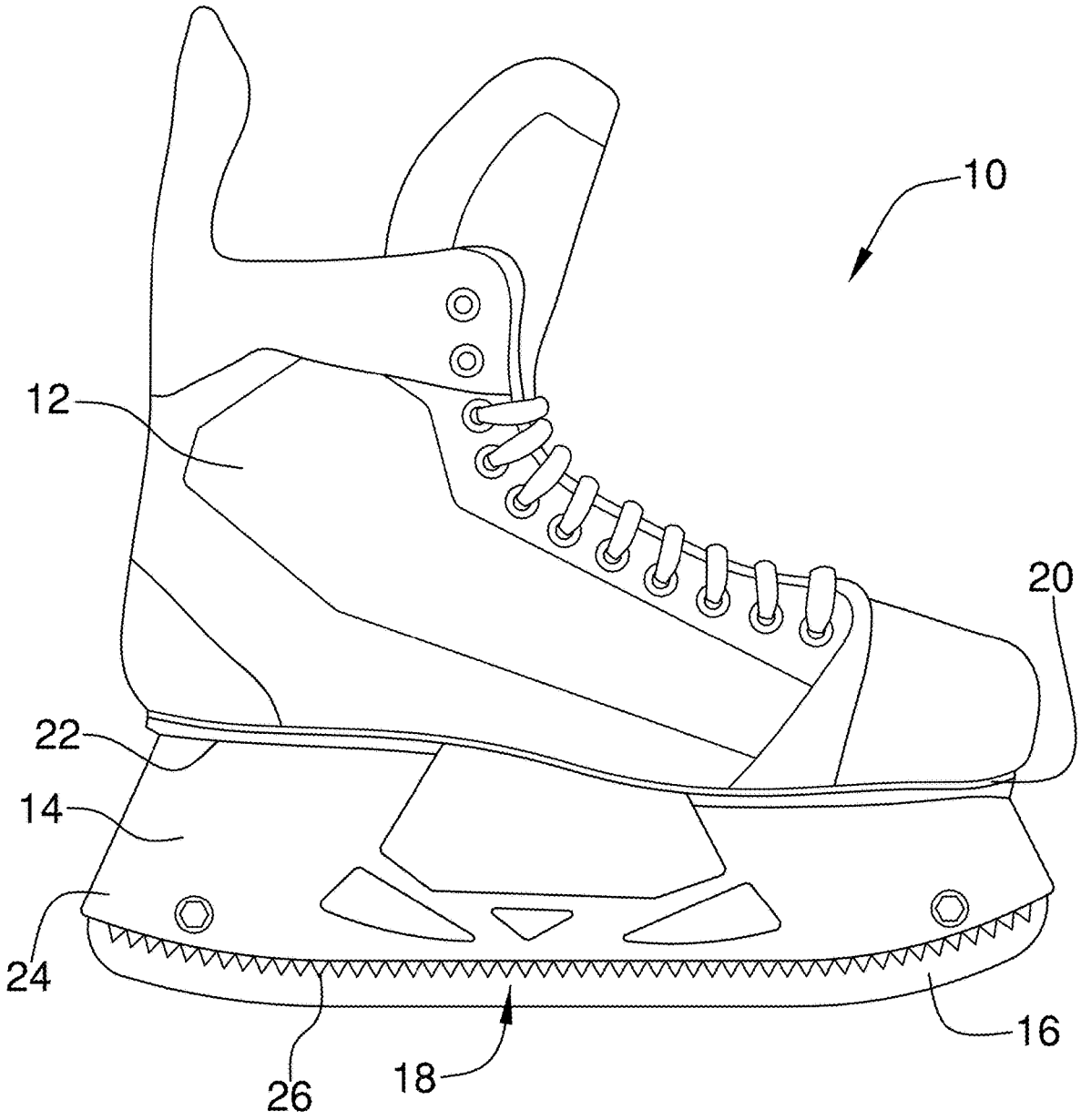
FIG. 1 is a side view of an ice hockey skate according to an embodiment of the disclosure.
Figure 2:
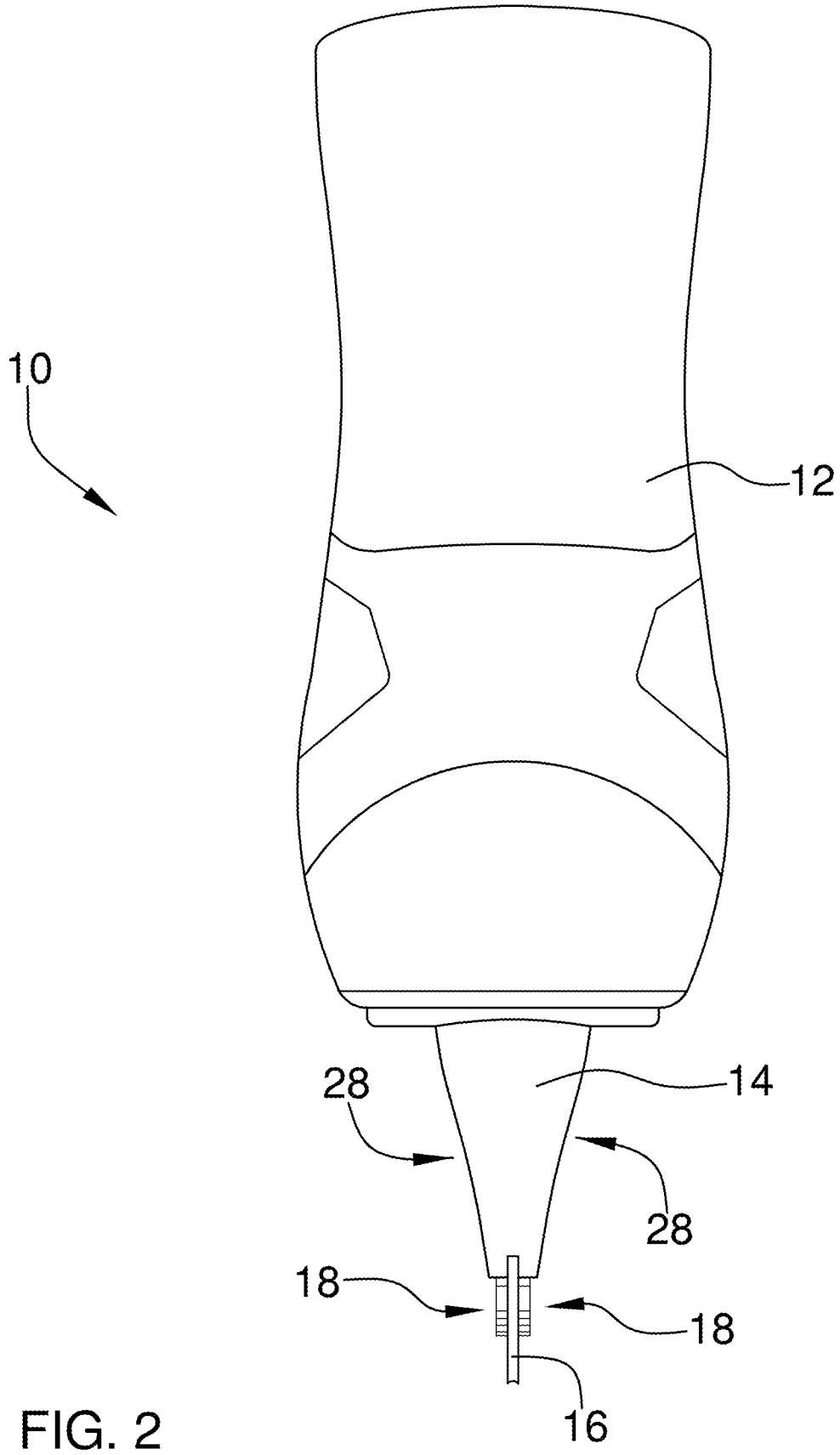
FIG. 2 is a rear view of an embodiment of the disclosure.
Figure 3:
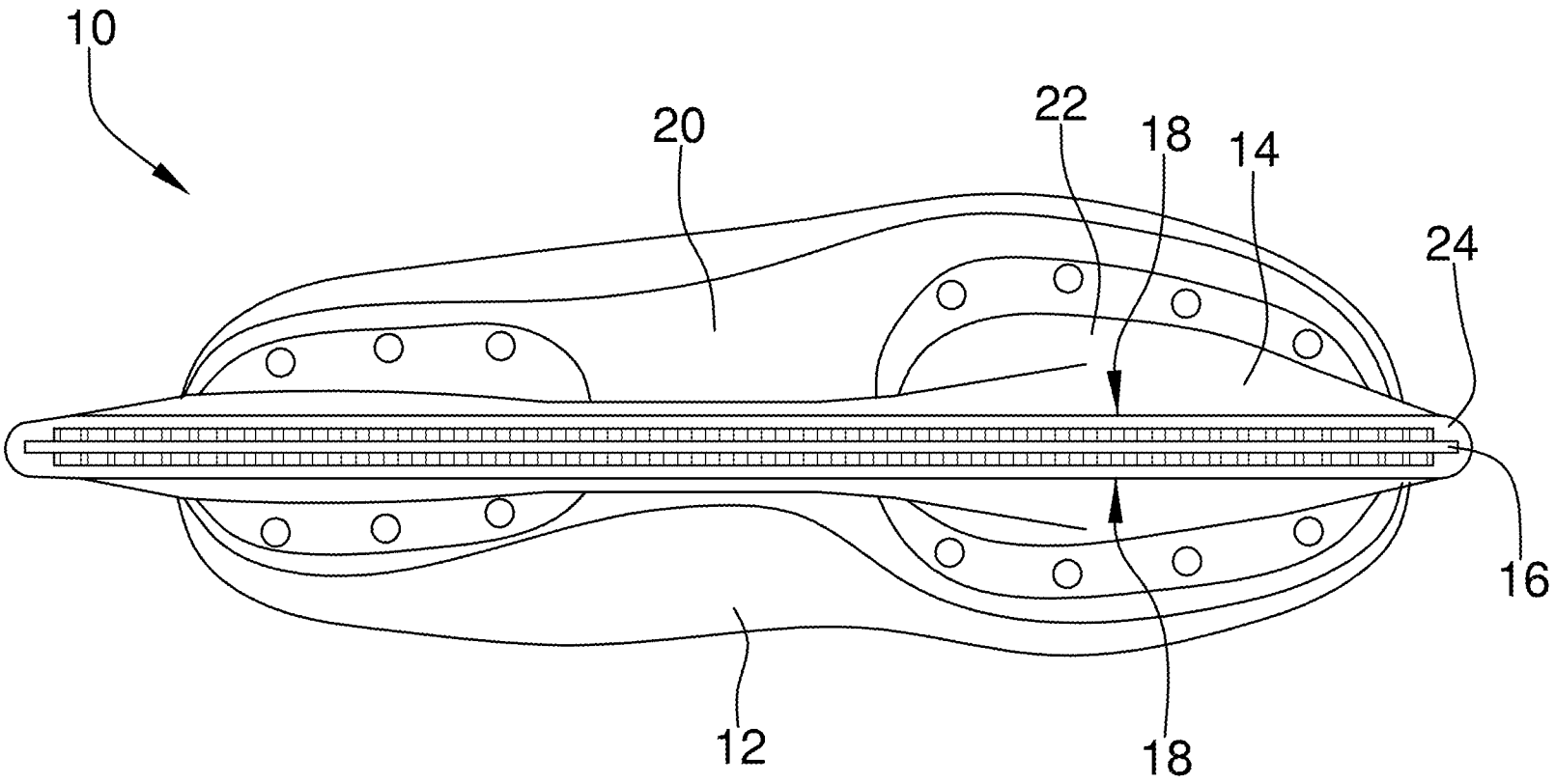
FIG. 3 is a bottom view of an embodiment of the disclosure.
Figure 4:
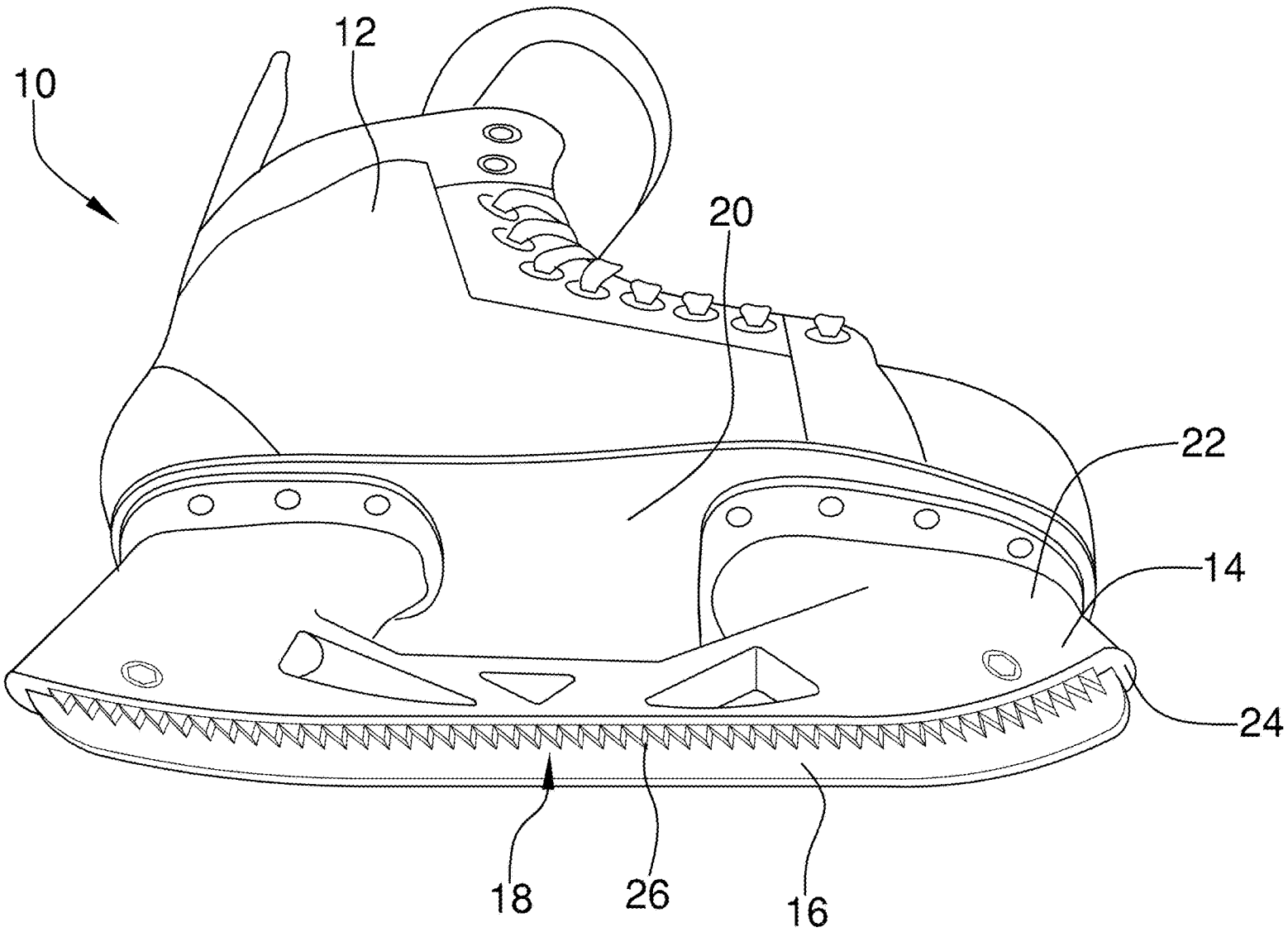
FIG. 4 is a perspective view of an embodiment of the disclosure.
Figure 5:
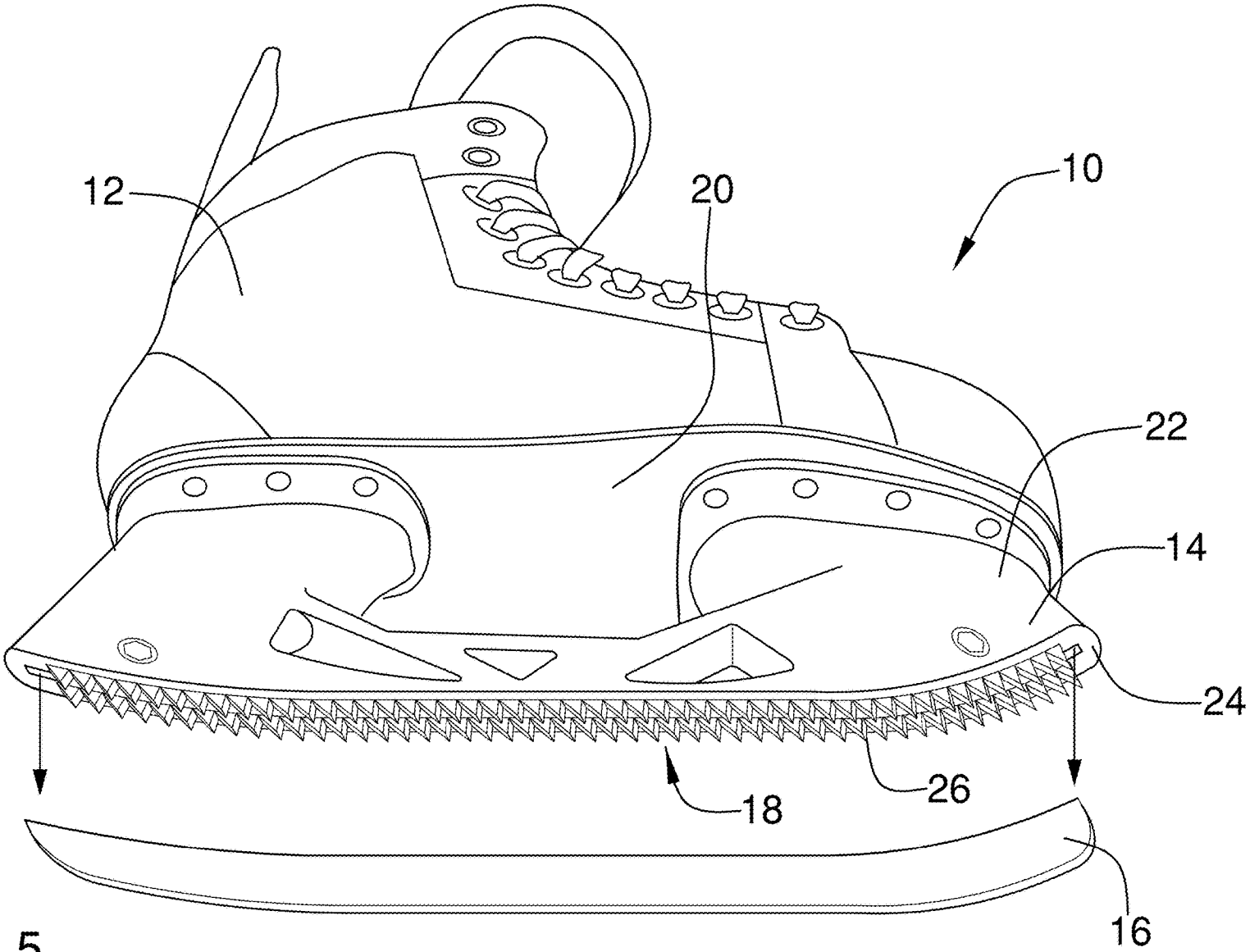
FIG. 5 is a perspective view of an embodiment of the disclosure.

With reference now to the drawings, and in particular to FIGS. 1 through 12 thereof, a new ice hockey skate embodying the principles and concepts of an embodiment of the disclosure and generally designated by the reference numeral 10 will be described.

As best illustrated in FIGS. 1 through 6, the ice hockey skate 10 generally comprises a boot 12, a blade housing 14, a blade 16, and a plurality of projections 18. The boot 12 includes a sole 20, which can be made of hard or stiff material. The blade housing 14 includes a mounting portion 22 attached to the sole 20 and a blade receptacle portion 24. The blade 16 is removably connected to the blade receptacle portion 24. The projections 18 project from the blade receptacle portion 24 adjacent the blade 16 and are designed to provide traction on an ice surface 70 upon disconnection of the blade 16.

Each of the projections 18 includes a tip portion 26 designed to dig into an ice surface 70. The tip portion 26 could be of essentially any design as long as the tip portion 26 is able to pierce the ice surface 70 to create the desired traction. In the exemplary embodiment shown in the figures, the tip portion 26 is essentially triangular and tapers to a point. The projections 18 therefore have the appearance of serrated teeth. However, other shapes are possible. For example, in one possible embodiment, the tip portion 26 could be essentially rectangular or trapezoidal, wherein instead of a sharp point there is a straight edge that is essentially parallel to the ice surface 70, much like the edges of the blade 16. Other shapes or combinations of shapes are also possible and could be selected to achieve desired strength and traction characteristics most suitable for ice.

In one possible embodiment, the projections 18 are permanently attached to the blade housing 14. However, in another possible embodiment, the projections 18 are removably attached to the blade housing 14. The projections 18 can be made from most any type of material, though a hard material would be preferred to provide the ability to dig into the ice and thereby provide the most traction. The projections 18 could be made from metal, an elastomer, plastic, or a combination of two or three of these materials. In the exemplary embodiment shown in the figures, the projections 18 are integrally formed with the blade housing 14 and thus are made from the same hard plastic as the blade housing 14. In another possible embodiment, the projections 18 could be attached by some type of anchor, such as a post inserted into the blade housing 14. In yet another possible embodiment, the projections 18 could be joined together on an elongated body, much like a knife or saw blade, that is inserted into or attached onto the blade housing 14.

In the exemplary embodiment, the blade receptacle portion 24 includes two side surfaces 28, and the projections 18 are divided into two rows, one projecting from each of the two side surfaces 28. However, in another possible embodiment, there could be only one row of projections 18, positioned at either one of the two side surfaces 28. It should be noted that the exemplary embodiment shows the projections 18 arranged closely together, though in another possible embodiment the projections 18 could be spaced apart, either individually or in groups.

Figure 6:
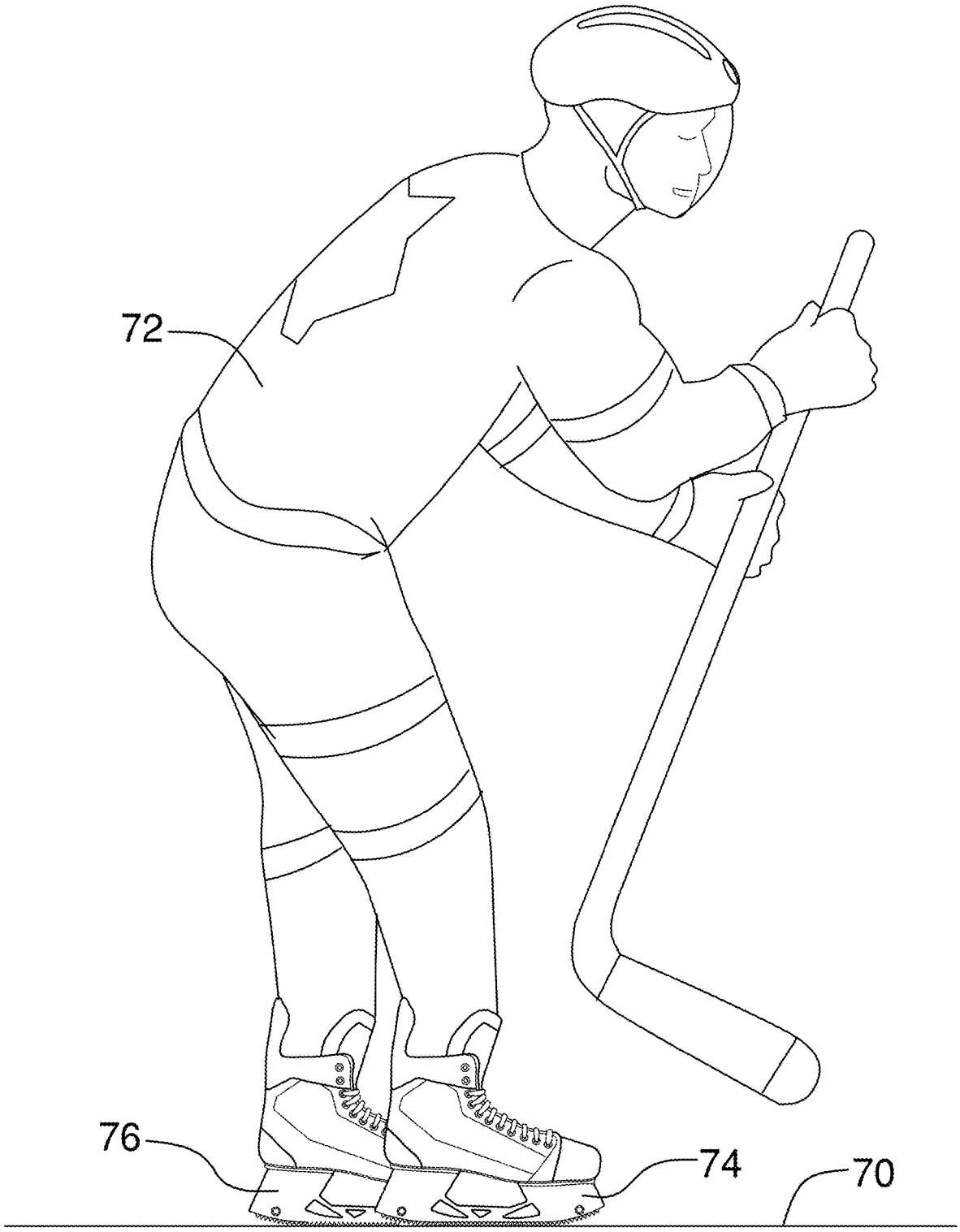
FIG. 6 is a side view of an embodiment of the disclosure in use.
Figure 7:
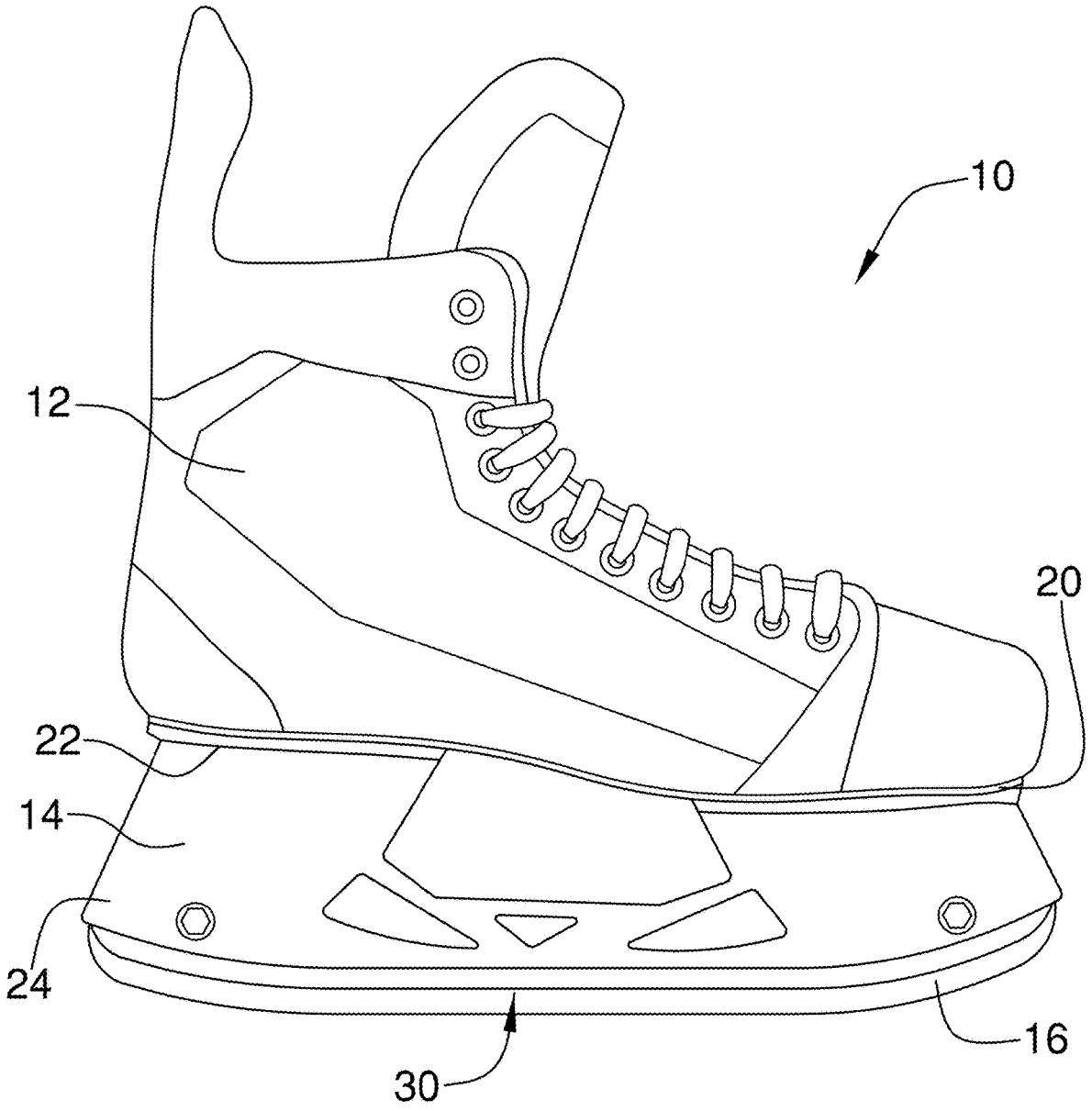
FIG. 7 is a side view of an ice hockey skate according to a second embodiment of the disclosure.
Figure 8:
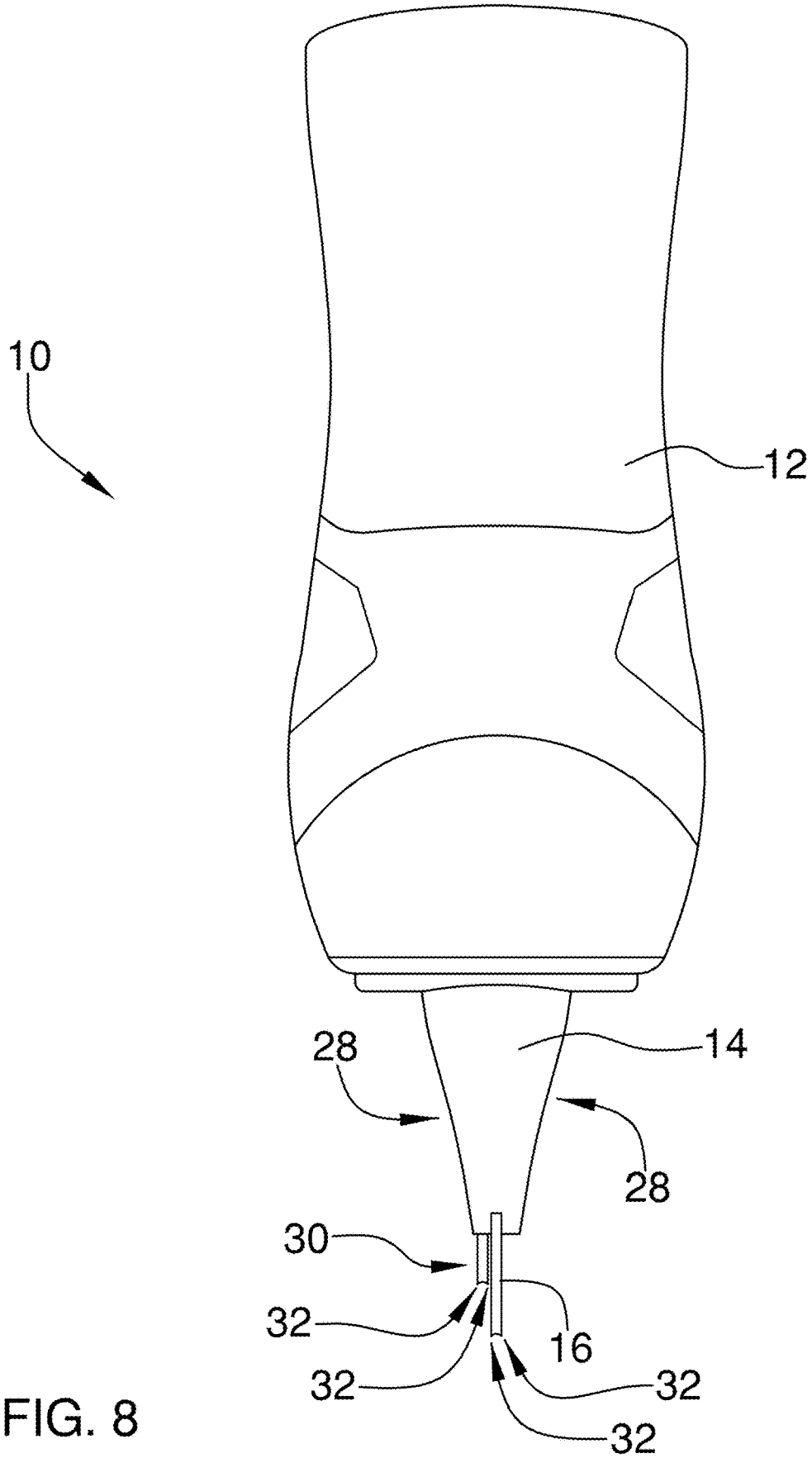
FIG. 8 is a rear view of the second embodiment of the disclosure.

As discussed herein, the projections 18 provide traction when the blade 16 is missing from one of the ice hockey skates 10, as shown in FIG. 6. The skater 72 uses the projections 18 of the damaged skate 74 to propel himself while he glides or skates on the intact skate 76 that still has the blade 16.

As best illustrated in FIGS. 7 through 12, a second embodiment of the ice hockey skate 10 replaces the plurality of projections 18 with a backup blade 30 or a blade extension 40. The backup blade 30 is essentially a shorter, temporary version of the blade 16 to provide the temporary traction needed to skate off of the ice surface. The blade extension 40 is an extension of the plastic blade housing 14. Each of the backup blade 30 and the blade extension 40 can provide the skater 72 with the ability to skate on both the damaged skate 74 and the intact skate 76, at least temporarily, so the skater 72 can exit the ice surface.

The backup blade 30 projects from the blade housing 14 next to and parallel to the blade 16 and is designed to provide traction on the ice surface upon disconnection of the blade 16. The positioning of the backup blade 30, or the blade extension 40, next to and parallel to the blade 16 ensures that the backup blade 30 does not interfere with the normal use of the blade 16 when skating, as opposed to such devices as training blades or similar.

In the exemplary embodiment, the backup blade 30 is made of metal. The backup blade 30 projects out of the blade housing 14 about half as far as the blade 16 such that the backup blade 30 is not in contact with the ice surface when the blade 16 is connected to the blade housing 14. In other possible embodiments, the backup blade 30 could be shorter or longer, provided that the backup blade 30 projects out of the blade housing 14 less than the blade 16 such that the backup blade 30 does not contact the ice surface during normal skating or usage of the blade 16.

The backup blade 30 is permanently attached to the blade housing 14. However, in one possible embodiment, the backup blade 30 could be removably coupled to the blade housing 14.

The backup blade 30 includes a pair of blade edges 32. However, in one possible embodiment, the backup blade 30 could be relatively flat or dull as the backup blade 30 is intended to provide temporary traction sufficient to aid in exiting the ice surface.

Figure 9:
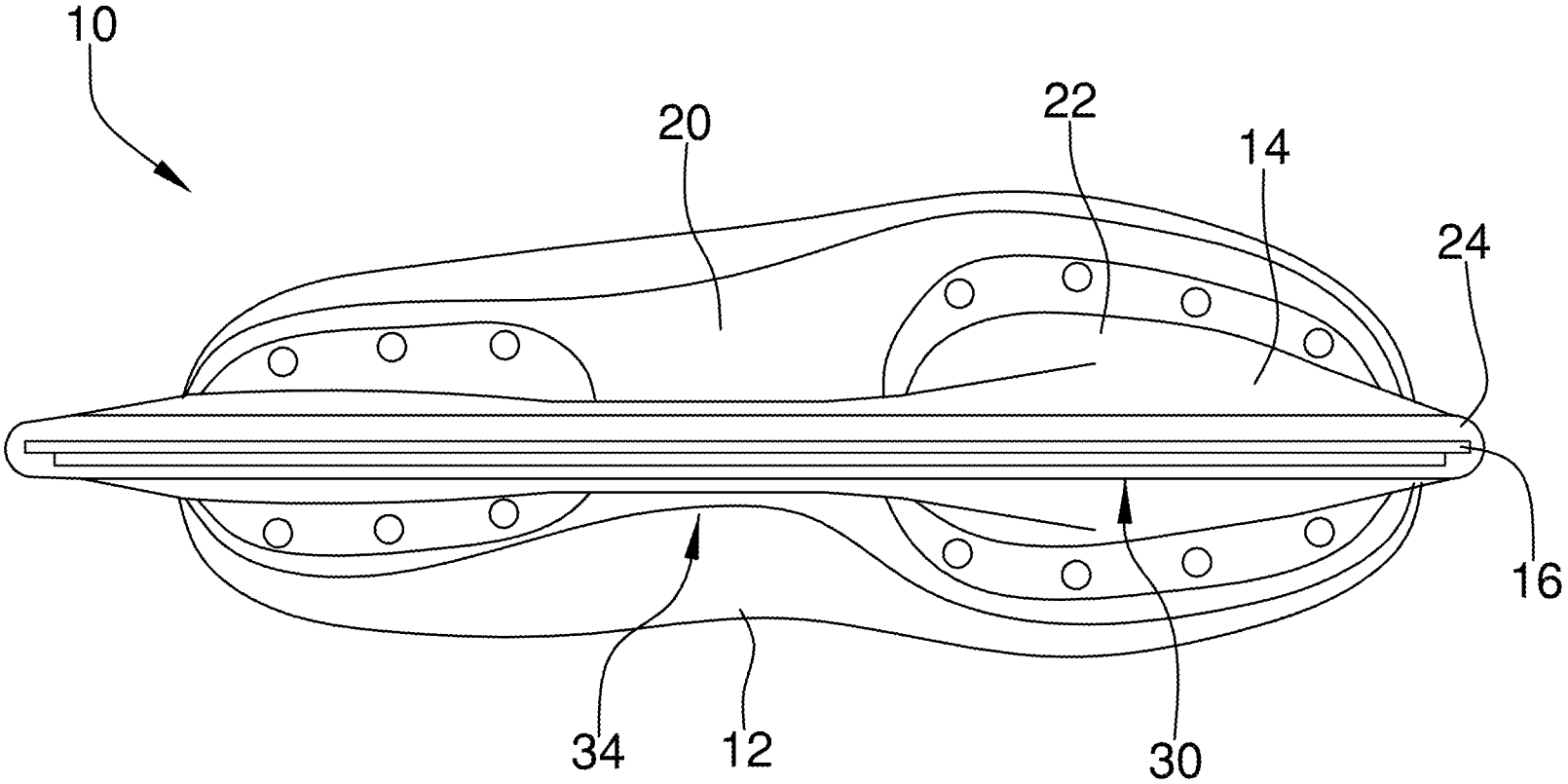
FIG. 9 is a bottom view of the second embodiment of the disclosure.
Figure 10:
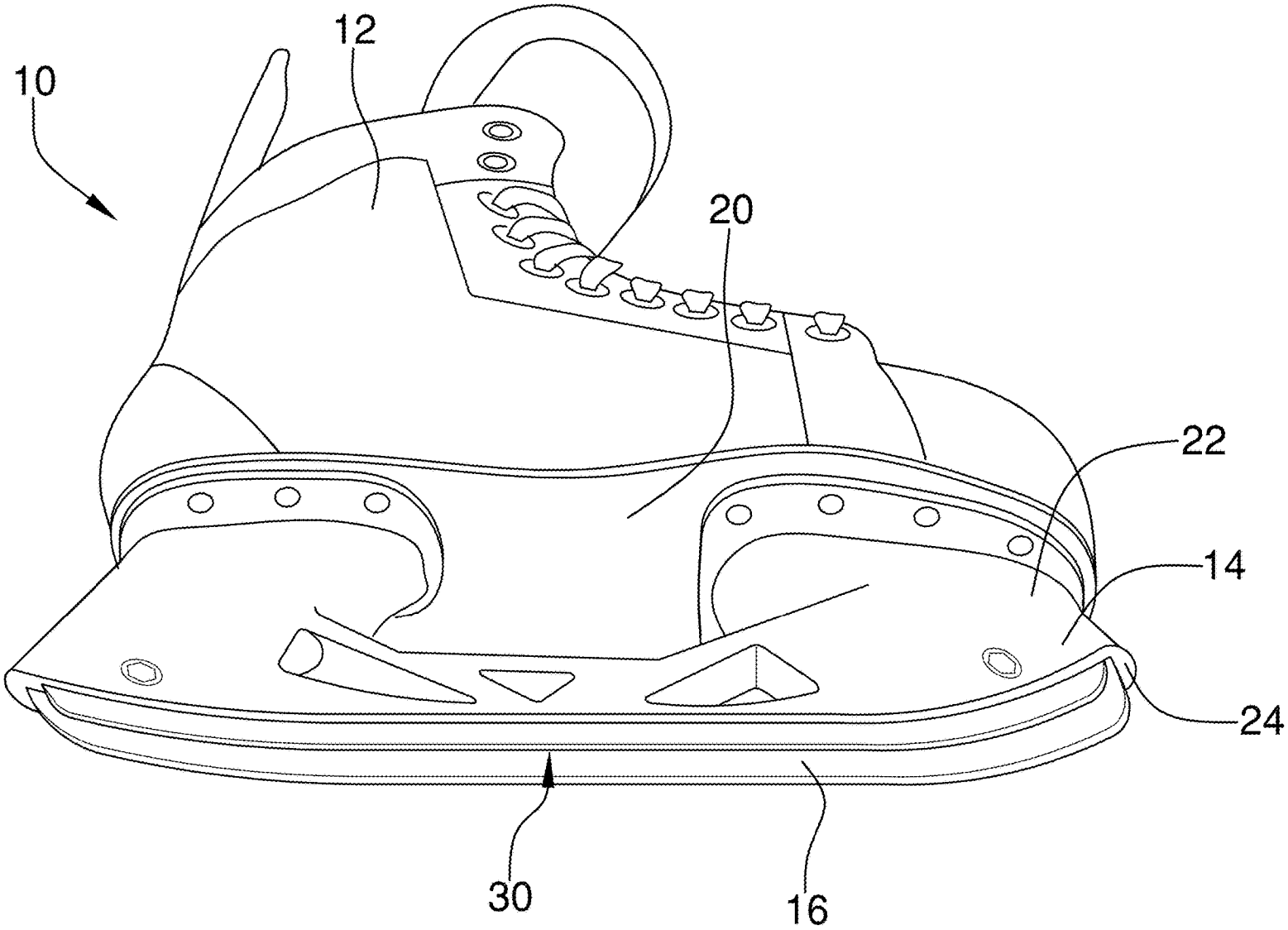
FIG. 10 is a perspective view of the second embodiment of the disclosure.
Figure 11:
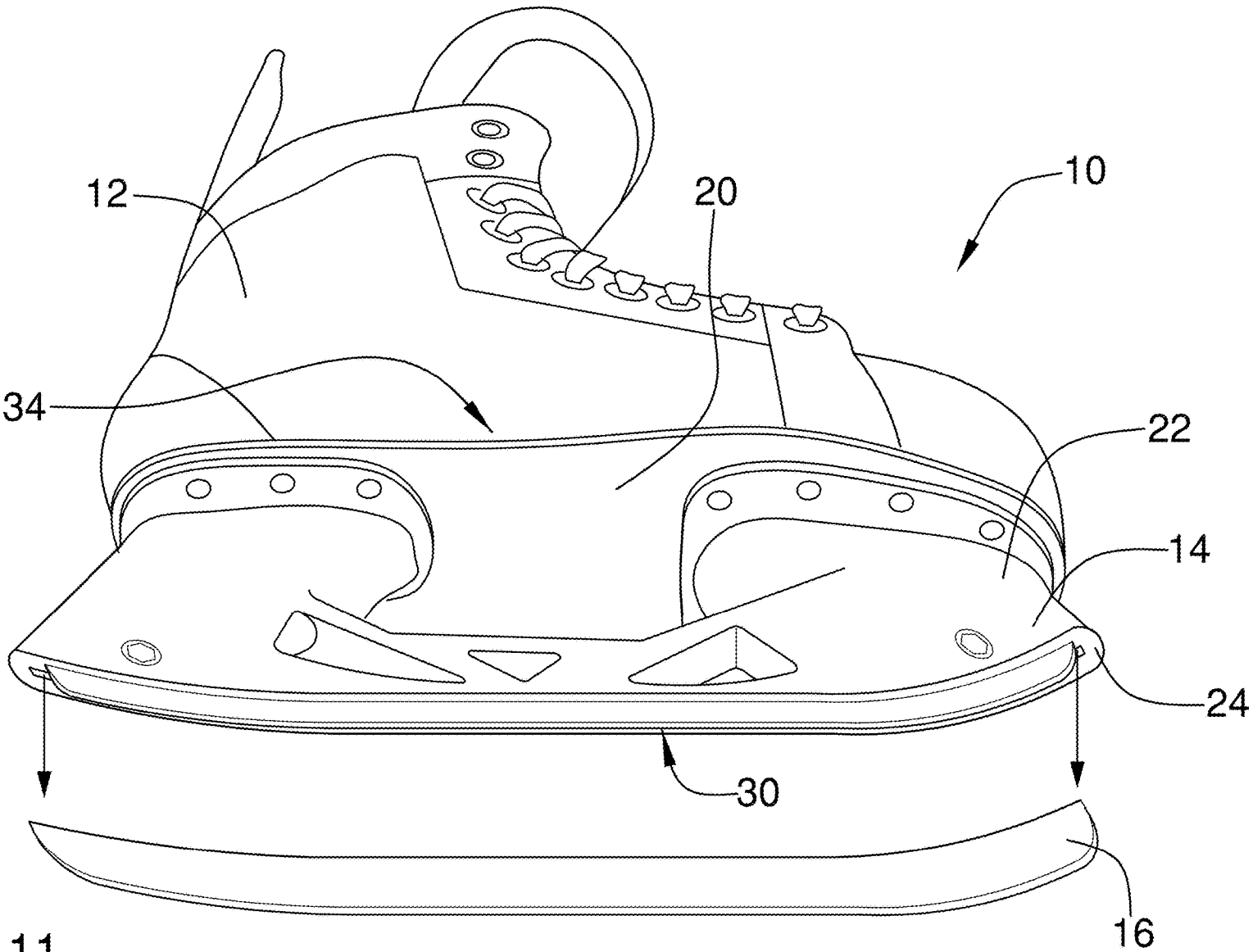
FIG. 11 is a perspective view of the second embodiment of the disclosure.

In the exemplary embodiment, as best seen in FIG. 9, the backup blade 30 is positioned on a side of the blade 16 adjacent an arch 34 of the boot. The backup blade 30 could alternatively be positioned on the other side of the blade 16 in another possible embodiment.

Figure 12:
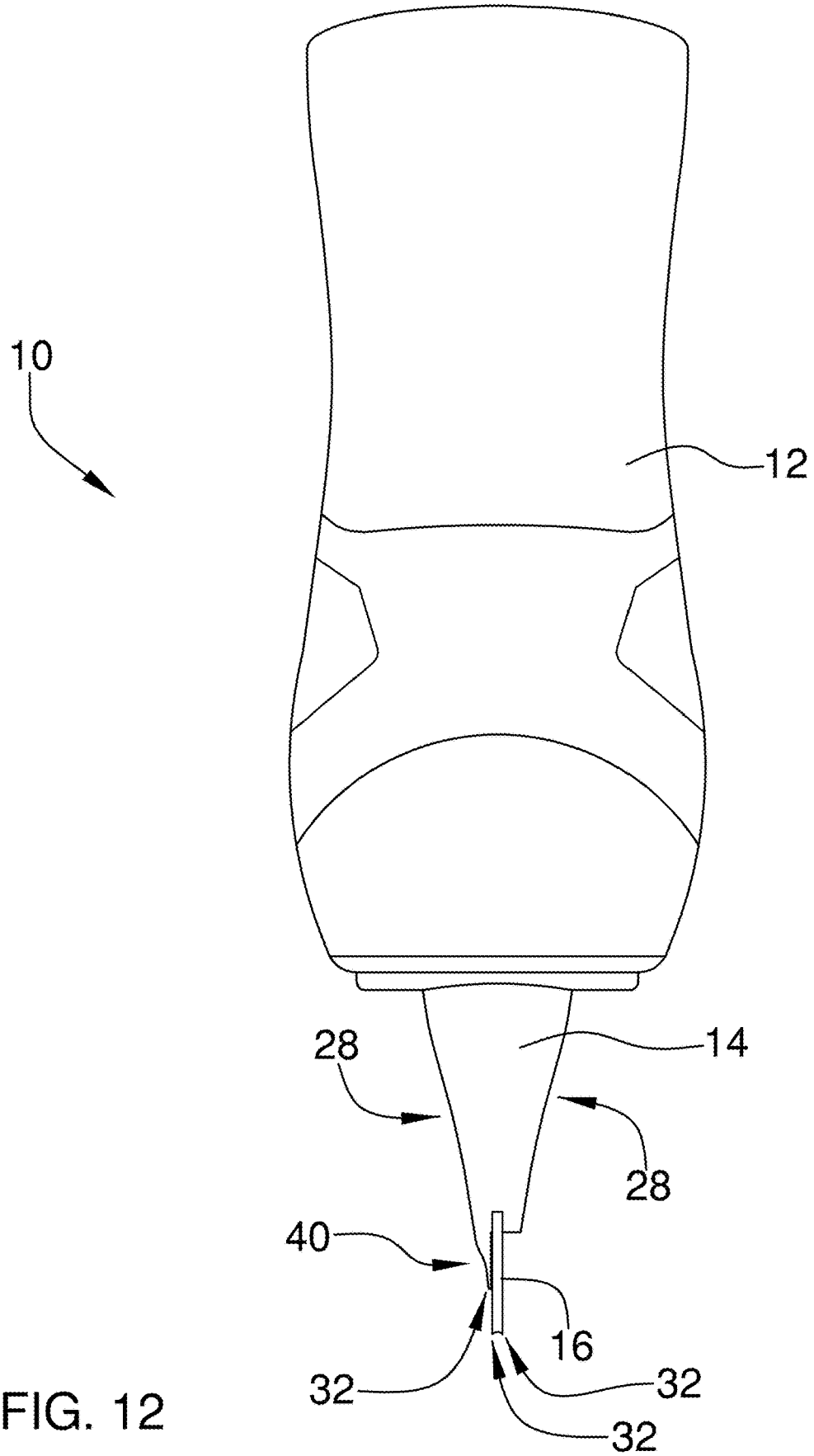
FIG. 12 is a rear view of an alternative version of the second embodiment of the disclosure.

In the exemplary embodiment in FIG. 12, the blade extension 40 is an alternative to the backup blade 30. The blade extension 40 projects from and is integrally formed with the blade housing 14 next to and parallel to the blade 16 and is designed to provide traction on the ice surface upon disconnection of the blade 16. The blade extension 40 is sized similarly as the backup blade 30, but could vary in length as desired.

The blade extension 40 tapers to the blade edge 32. However, in another possible embodiment, the blade extension 40 could be shaped similarly to the backup blade 30 to have a pair of the blade edges 32.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An ice hockey skate comprising:

a boot including a sole;

a blade housing including a mounting portion attached to said sole and a blade receptacle portion;

a blade removably connected to said blade receptacle portion; and a backup blade projecting from said blade housing next to and parallel to said blade and configured to provide traction on an ice surface upon disconnection of said blade, said backup blade is positioned on a side of said blade adjacent an arch of said boot.

2. The ice hockey skate of claim 1, wherein said backup blade comprises metal.

3. The ice hockey skate of claim 2, wherein said backup blade projects out of said blade housing about half as far as said blade such that said backup blade is not in contact with the ice surface when said blade is connected to said blade housing.

4. The ice hockey skate of claim 3, wherein said backup blade is permanently attached to said blade housing.

5. The ice hockey skate of claim 4, wherein said backup blade includes a pair of blade edges.

6. The ice hockey skate of claim 1, wherein said backup blade projects out of said blade housing about half as far as said blade such that said backup blade is not in contact with the ice surface when said blade is connected to said blade housing.

7. The ice hockey skate of claim 1, wherein said backup blade is permanently attached to said blade housing.

8. The ice hockey skate of claim 1, wherein said backup blade includes a pair of blade edges.

9. An ice hockey skate comprising:

a boot including a sole;

a blade housing including a mounting portion attached to said sole and a blade receptacle portion;

a blade removably connected to said blade receptacle portion; and a blade extension projecting from and integrally formed with said blade housing next to and parallel to said blade and configured to provide traction on an ice surface upon disconnection of said blade, said blade extension is positioned on a side of said blade adjacent an arch of said boot.

10. The ice hockey skate of claim 9, wherein said blade extension projects from said blade housing about half as far as said blade such that said blade extension is not in contact with the ice surface when said blade is connected to said blade housing.

11. The ice hockey skate of claim 10, wherein said blade extension tapers to a blade edge.

12. The ice hockey skate of claim 9, wherein said blade extension tapers to a blade edge.

* * * * *